US006447404B1

(12) United States Patent
Wilbur

(10) Patent No.: US 6,447,404 B1
(45) Date of Patent: Sep. 10, 2002

(54) SEPARABLE-SHAFT GOLF CLUB

(76) Inventor: Kurt C. Wilbur, 1922 J.J. Pearce, Richardson, TX (US) 75081

( * ) Notice: Subject to any disclaimer, the term of this patent is extended or adjusted under 35 U.S.C. 154(b) by 0 days.

(21) Appl. No.: 09/654,993

(22) Filed: Sep. 5, 2000

(51) Int. Cl.[7] ..... A63B 53/16
(52) U.S. Cl. ..... 473/296; 473/409
(58) Field of Search ..... 473/296, 298, 473/299, 288, 409; 74/548; 16/110 R; 81/177.1; 403/354, 360, 361, 370

(56) References Cited

U.S. PATENT DOCUMENTS 3,887,524 A * 6/1975 Kirchner
4,253,666 A 3/1981 Murphy ..... 273/80.1
4,340,227 A * 7/1982 Dopkowski
4,856,782 A 8/1989 Cannan ..... 273/80
5,390,921 A * 2/1995 De Ruyter
5,413,338 A 5/1995 Kawamatsu ..... 273/80
5,597,362 A 1/1997 Lee et al. ..... 473/244
5,765,691 A * 6/1998 Hall
5,792,006 A 8/1998 Hesser ..... 473/239
5,857,923 A * 1/1999 Veller
6,039,659 A 3/2000 Hamm ..... 473/306

* cited by examiner

*Primary Examiner*—Stephen Blau
(74) *Attorney, Agent, or Firm*—Robert H. Johnston, III

(57) ABSTRACT

A golf club includes a first and a second hollow shaft members that are releasably connected by a hollow connector. The hollow connector has a hollow male connector that has a first portion and a second portion. The second portion is threaded on an exterior surface. The first portion of the male connector is coupled to one of the connecting ends of the shaft members. The hollow connector also has a hollow female connector that is coupled to an interior portion of the other shaft member. The threads on the exterior of the male connector are releasably mated with interior threads on the female connector to provide an assembled golf club that may be disassembled for travel, but has characteristics that do not substantially vary from a similar conventional club. A method of manufacturing a separable-shaft golf clubs is also presented.

14 Claims, 2 Drawing Sheets

SEPARABLE-SHAFT GOLF CLUB

FIELD OF THE INVENTION

This invention relates generally to golf clubs, and more particularly, to a separable-shaft golf club.

BACKGROUND OF THE INVENTION

Practice is essential to developing a good and consistent golf game. Many golf enthusiasts enjoy practicing their game at the golf course, driving range, home, and on the road. When a golf player is traveling, he or she must either take his or her personal golf clubs or rent a set of clubs. Traveling with golf clubs, however, is difficult because they are long and cumbersome. When traveling by commercial airplane, they must be checked in the cargo section. While a golfer may only want a few clubs on the trip with which to practice, they are generally too long to fit within a suitcase or other travel bag for convenient transportation. Further, renting clubs is usually undesirable because of the expense and because the length, weight, and feel of the clubs may vary from the golfer's usual set. The differences may cause the practice session with rented clubs to do more harm than good. The club characteristics can be that important.

The overall weight, balance (or swing weight), flexibility, and the point of flexing of a golf club are all important characteristics to the golfer. The shaft is a major factor in determining all these characteristics. If one of these characteristics is substantially changed on a set of golf clubs, compared to a set that the golfer normally uses, it will interfere with his or her game.

Golf clubs designed for easy transportation have been proposed, but the clubs have not offered club characteristics sufficiently consistent with standard clubs. For example, U.S. Pat. No. 5,792,006 (Hesser) presents a collapsible, telescoping golf club shaft. Screws are used to hold the shaft in the assembled position and are removed to telescope the shaft for travel. As another example, U.S. Pat. No. 5,857,923 (Veller) discloses a golf putter that has a step removed in the middle of the putter. The putter shaft ends formed at the break where the step was removed are engaged by a solid screw that is placed in one end and a threaded sleeve in the other. Veller uses an overhanging lip at the resultant joint to provide stability to the assembled putter.

BRIEF SUMMARY OF THE INVENTION

Therefore, a need has arisen for a golf club that is easily transportable that addresses the shortcomings of the prior art. According to the present invention, a golf club includes a first hollow shaft member and second hollow shaft member that are releasably connected by a hollow connector. The hollow connector has a hollow male connector having a first portion and an externally-threaded second portion. The first portion of the male connector is coupled to one of the connecting ends of the shaft members. The hollow connector also has a hollow female connector with internal threads that is coupled to an interior portion of the other shaft member. The threads on the exterior of the male connector are releasably mated with the interior threads on the female connector to provide an assembled golf club that may be disassembled for travel. This separable-shaft golf club has characteristics that are reasonably consistent with a standard golf club.

According to another aspect of the present invention, a method for making a separable-shaft golf club is provided that includes the following steps: providing a standard hollow steel golf club having a shaft; cutting the shaft of the standard golf club at approximately a middle point of the shaft to form a first shaft member and a second shaft member; coupling a hollow male connector to the first shaft member or the second shaft member so that threads of the second portion of the male connector extend from the first shaft member or second shaft member; coupling a hollow female connector, which has an interior threaded portion sized and configured to mate with the threads on the external portion of the male connector, to the other shaft member.

BRIEF DESCRIPTION OF THE DRAWING

The accompanying drawing is incorporated into and forms a part of the specification to illustrate the preferred embodiment of the present invention. Various advantages and features of the invention will be understood from the following detailed description taken in connection with the appended claims and with reference to the attached drawing figures in which:

DETAILED DESCRIPTION OF THE INVENTION

The preferred embodiments of the present invention and its advantages are best understood by referring to FIGS. 1–4 of the drawings, like numerals being used for like and corresponding parts of the various drawings.

Figures 1, 4:
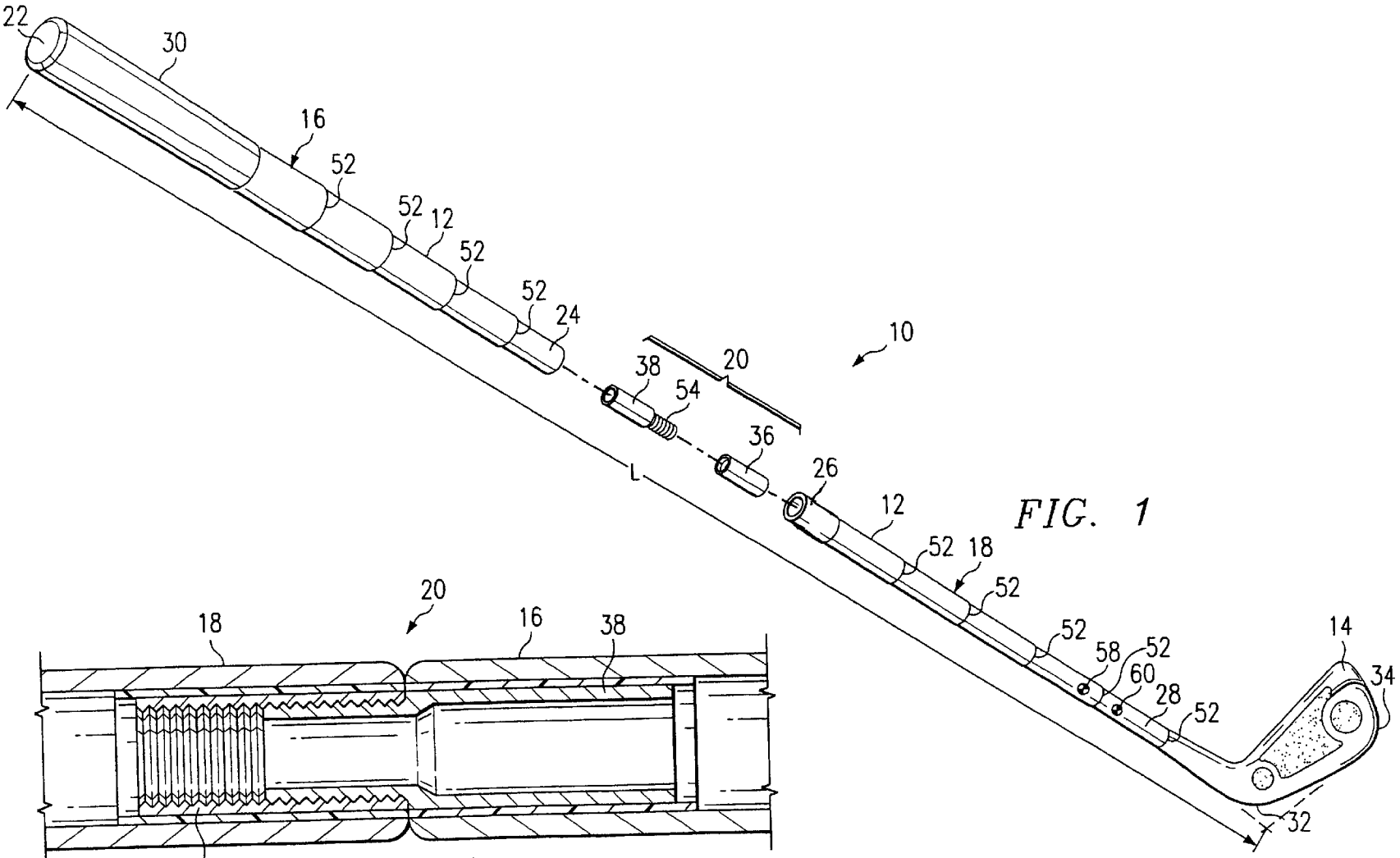
FIG. 1 is an exploded perspective view of a golf club with a separable shaft in accordance with the present invention.
FIG. 4 is a cross sectional view in elevation of the hollow male connector and hollow female connector of the golf club of FIG. 1 in an assembled configuration.

Referring to FIG. 1, a separable-shaft golf club 10 includes shaft 12 and a club head 14. The shaft 12 has a first hollow shaft member 16 and a second hollow shaft member 18. The shaft members 16 and 18 are coupled by a releasable hollow connector, or connection, 20. The golf club 10 may thus be placed in an assembled configuration (see FIG. 4) or a disassembled configuration (see FIG. 3). The club 10 may be conveniently transported in the disassembled position, but has reasonable club characteristics when in the assembled position that do not vary substantially from a standard club.

The first shaft member 16, which is preferably a hollow steel shaft member, has a first gripping end or shaft butt end 22 and a second end or coupling end 24. The second shaft member 18, which is also preferably of hollow steel, has a first end or coupling end 26 and a second end or club end 28. The first end 22 of the first hollow shaft member 16 is attached to a golf handle or grip 30. The second end 28 of second hollow shaft member 18 is attached to a golf club head 14. While an iron is presented for illustration purposes in the figures, the golf club 10 may also be a driver or a putter.

The golf club 10 has length L, which is measured from shaft end 22 to a reference point defined by the intersection of a line parallel with the heel 32 of the golf club head 14 and a line parallel to the shaft 12. The length, L, is typically in the range of 35 to 45 inches.

The first hollow shaft member 16 is joined to the second hollow shaft member 18 by a connection 20. The connection 20 has a hollow female connector 36 and a hollow male connector 38. The connection 20 that is formed by female connector 36 and hollow male connector 38 provides strength and stability to the assembled shaft 12 while maintaining light weight and balance. The connection 20 has a substantial amount of the material forming it on an outer perimeter thereby approximating a typical steel hollow shaft. This design is to provide strength and rigidity while remaining light-weight.

Figure 2:
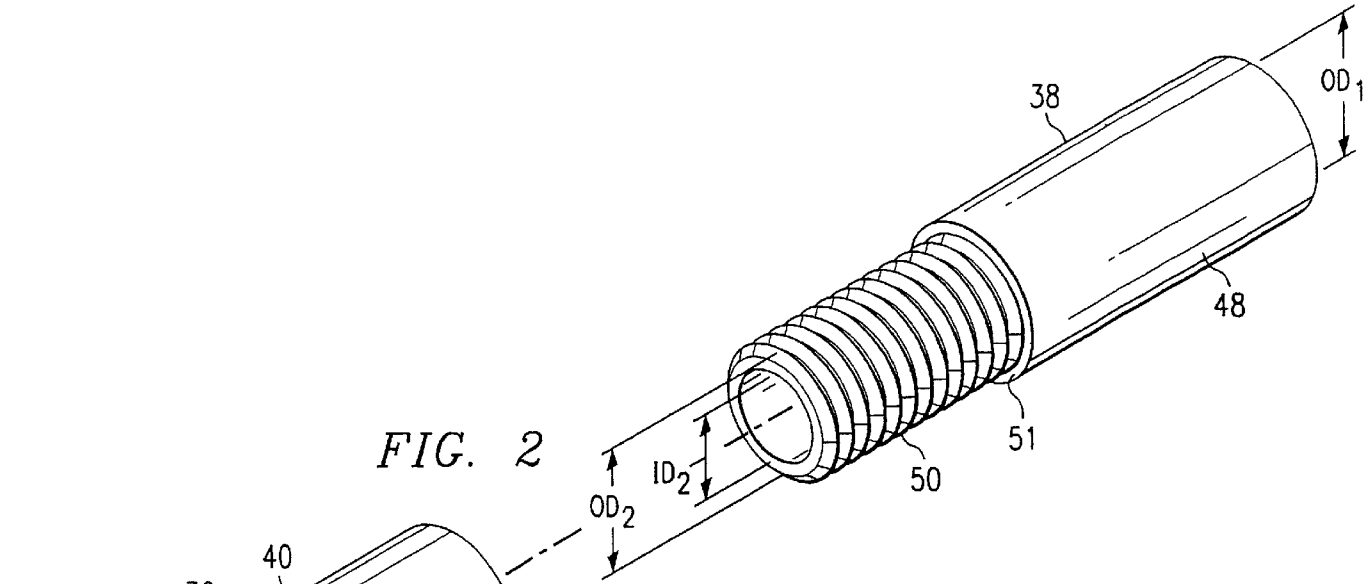
FIG. 2 is a perspective view of the hollow male connector and hollow female connector of the golf club of FIG. 1 in a disassembled configuration.
Figure 3:
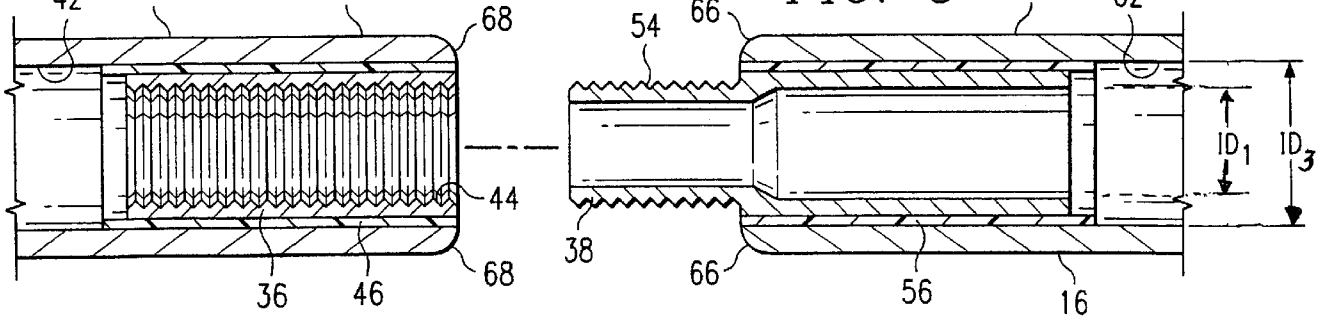
FIG. 3 is a cross sectional view in elevation of the hollow male connector and hollow female connector of the golf club of FIG. 1 in a disassembled configuration.

Referring to FIGS. 1–4, and primarily to FIGS. 1 and 2, the hollow female connector 36 has an exterior surface 40 and an interior portion that includes internal threading 44. When installed, the hollow female connector 36 is recessed into the second hollow shaft member 18 substantially flush with the first end 26 of the shaft member 18. The hollow female connector 36 is secured by an adhesive or by spot welding or other connection technique to the interior 42 of the first end of the second shaft member 18. Preferably, an epoxy adhesive 46 (shown in FIG. 3) is used to secure the hollow female connector 36 inside the shaft member 18. The female connector 36 has an inside diameter, $ID_4$, and an outside diameter, $OD_3$.

The hollow male connector 38 has a first portion 48 and a second portion 50. The first portion 48 has a first outside diameter, $OD_1$, and the second portion 50 has a second outside diameter $OD_2$. Preferably, the outside diameters have the following relationship: $OD_1$, $>OD_2$. Thus, a step 51 is formed between them. The smaller second portion 50 has external threads 54. To help keep the weight to a minimum, the male connector 38 is hollowed out. The first portion 48 is hollowed out to have an inside diameter, $ID_1$. The second portion 50 is also hollowed out to form a second inside diameter, $ID_2$. The hollow male connector 38 and the hollow female connector 36 are preferably made from steel, but other materials may be used. The hollow male connector 38 is partially inserted such that step 51 is substantially flush with the second end 24 of first shaft member 16. This leaves the external threading 54 exposed when in the disassembled configuration. The exterior of the first portion 48 of the hollow male connector 38 is secured to an interior portion of shaft 12 by an adhesive or by spot wielding. An epoxy deposit (see 56 in FIG. 3) is preferably used to secure the hollow male connector 38 to the interior of the shaft 12.

It is desirable to have connector 20 formed with as much of its material around an outer circumference as possible. $OD_1$, is preferably only slightly smaller than the interior diameter, $ID_3$, of the first shaft member 16 at the second end 24. It is preferable that the interior diameter $ID_1$, of the first portion 48 of male connector 38 be at least 70% of the interior diameter $ID_3$ of the shaft 12 at the second end 24 or first end 26. More preferably $ID_1$, will be at least 75% of $ID_3$ and more preferably yet will be 90% of $ID_3$. It is also desirable to have $ID_2$ as big as possible. $ID_2$ is preferably at least 40% of $ID_3$, and more preferably at least 50% or greater of $ID_3$. Similarly, $ID_4$ is preferably at least 70% (and more preferably 90% or more) of the interior diameter of the shaft 12 where the female connector 36 is placed.

In the disassembled position, the shaft 12 is in two pieces 16 and 18 and can be readily transported. In the assembled position, a single shaft 12 is formed by connecting the shaft members 16 and 18 with the connection 20. In the assembled position, the partial external threading 54 of the hollow male connector 38 releasably engages the internal threading 44 of the hollow female connector 36 such that the second end 24 of first hollow shaft member 16 comes into contact or almost into contact with the first end 26 of second hollow shaft member 18. Preferably, all the threads on the hollow female connector 36 and hollow male connector 34 are "reverse threads" on a right-handed club head and "standard threads" on a left-handed club head. In this manner, the threaded connection between the second hollow shaft member 18 and first hollow shaft member 16 is urged tighter each time a golf ball is struck.

Referring again to FIG. 1, the female connector 36 and the male connector 38 are hollow to avoid placing unnecessary mass at the center of the club 10. The additional mass of the connector 20 should add as small of weight as possible when compared to the weight of an otherwise identical conventional club having a solid, integral shaft member and no connection member ("a similar conventional club"). This is particularly true since the connection 20 is formed in a middle portion of the club shaft 12. With this arrangement, the weight of the separable-shaft golf club 10 preferably varies less than 10% from a similar conventional club and more preferably varies less than 5%. Further, the center of gravity (C.G.) of the separable-shaft golf club 10 preferably varies less than 10% of club length L as compared to a similar conventional club, and more preferably varies less than 5%, and more preferably still varies less than 3%. The effect on the center of gravity (C.G.) is qualitatively shown in FIG. 1. The location of the C.G. of the club 10 with connector 20 is shown by reference numeral 58 and without the connector the location of the C.G. is shown by reference numeral 60. The C.G. is typically with in a few inches of a point 14 inches from the intersection of the line parallel to the bottom of the club head 34 and a line parallel to the shaft. In addition to remaining reasonably close in weight and balance, the club 10 also remains close on flexibility and point of flex. Thus, club 10 should feel normal to a golfer.

The golf club 10 may be created by retrofitting a conventional club or manufacturing it from scratch. When converting a conventional stepped cylindrical shaft having a length L to a separable-shaft embodiment, the shaft is severed with a pipe cutter, saw, or other cutting tool at a point approximately equal to ½ of L. If ½ L measures on a step of a conventional golf club, the cut is made in the middle of the step closer to the first end 22 of the first hollow shaft member 16. The cut divides the club into two portions, the first hollow shaft member 16 and the second hollow shaft member 18.

An interior portion 62 of the second end 24 of the first hollow shaft member 16 is abraded with a rasp or sand paper or other means. Similarly, an interior portion 42 of the first end 26 of the second hollow shaft member 18 is abraded. The coarse, uneven surface is more suitable for applying an adhesive. The second end 24 of the first hollow shaft member 16 may be rounded to form a rounded portion 66, and the first end 26 of the second hollow shaft member 18 may be slightly rounded off to form rounded portion 68. This may be accomplished with a rasp at the same time the abrading of the interior portions or by virtue of cutting with a pipe cutter or other means. The rounded ends allow the first end 26 to rest substantially if not completely flush with second end 24 when the connection 20 is in the fully assembled position. The outer surface of the hollow female connector 36 and the outer surface of the first portion 48 of the male connector are also preferably abraded. The hollow female connector 36 and the hollow male connector 38 are secured in each respective shaft member preferably by an epoxy contact adhesive 46 and 56. After curing the adhesives 46 and 56, the club 10 is ready for use. Of course, this is but one example of how to make club 10, and it is to be understood that numerous alterations are possible.

In one specific embodiment constructed and tested, the male connector 38 had an overall length of approximately 1.70 inches. The first portion 48 was approximately 1.0 inch long with an $OD_1$, of 0.43 inches. The second portion 50 was approximately 0.70 inches long with $OD_2$ of 0.372 inches with ⅜ inch threading on the exterior. The first portion of the male connector 38 was hollowed with an inside diameter, $ID_1$, of approximately ⅜ of an inch. The second portion 50 of the hollow male connector 38 had an interior diameter, $ID_2$, of 3/16 of an inch. The hollow female connector 36 was approximately 1.0 inches in length with an outside diameter, $OD_3$, of approximately 0.43 inches and an inside diameter, $ID_4$, of approximately ⅜ of an inch. The assembled connector 20 had a length of approximately 2.0 inches, which was sized to be approximately the length between two consecutive steps 52 on golf club 10. By not removing a step (between steps 52) from the shaft 12 but inserting the connector into the shaft, the shaft 10 stiffness is substantially maintained. In this illustrative embodiment, both the male connector 38 and the hollow female connector 36 were made from 12L14 steel, and the assembled connector 20 weighted approximately 14 grams and the entire club 10 weighed about 449 grams. Thus the connector made up about 3% of the club weight, and the separable-shaft golf club varied in weight by about 3.2% from the weight of a similar conventional club. The center of gravity was reflected in the club having a swing weight of D1 on the scale used by Golfsmith, Inc.

Although the present invention and its advantages have been described in detail, it should be understood that various changes, substitutions, and alterations can be made therein without departing from the spirit and scope of the invention as defined by the following claims. For example, the invention is presented in the context of a hollow steel shaft, but a composite shaft with a connector might be used. As another example, steps are shown on the shaft, but a stepless shaft design might be used as well. As yet another example, the male connection member 38 is shown attached to the first shaft member 16 and the female connector 36 is shown connected to the second shaft member 18, but it could be done the other way as well. Another example is that the hollow female connector 36 may be replaced by forming threads on the interior portion of first end 26 of second shaft member 18 so that the male connector would mate directly with it. Similarly, when manufacturing from scratch, the threaded portion 54 of male connector 38 might be formed directly on the second end 24 of first shaft member 16. These are but a few examples of possible alternatives.

What is claimed is:

1. A golf club having a length, L, and a center of gravity comprising:

a first hollow shaft member having a first end and a second end;

a second hollow shaft member having a first end and a second end;

a club head coupled to the second end of the second hollow shaft member;

a hollow male connector having a first portion (which has an interior diameter of $ID_a$) and a second portion (which has an interior diameter of $ID_b$), the first portion coupled in an interior portion of the second end of the first hollow shaft member or to an interior portion of the first end of the second shaft member, and the second portion of the hollow male connector having external threads;

a hollow female connector portion (which has an interior diameter of $ID_c$) having an exterior and a threaded interior, the exterior of the female connector coupled to the interior portion of the first end of the second shaft member or the interior portion of the second end of the first shaft member;

wherein the external threads of the second portion of the hollow male connector are sized and configured to mate with the threaded interior of the hollow female connector to provide a releasable connection allowing the club to have an assembled configuration and a disassembled configuration; and wherein the hollow male connector and the hollow female connector are operable to form a hollow connection when mated and wherein $ID_a > ID_b$ and $ID_c > ID_b$.

2. The golf club of claim 1, wherein the center of gravity of the golf club in the assembled configuration is within plus or minus 5% of the club length L of the center of gravity of a club that is identical except having an un-severed, integral shaft member and having no hollow male connector and no hollow female connector.

3. The golf club of claim 1, wherein the male connector is coupled to the second end of the first hollow shaft member by adhesive.

4. The golf club of claim 1, wherein the hollow female connector is coupled to the first end of the second hollow shaft member by an adhesive.

5. The golf club of claim 1, wherein the external threads of the hollow male connector and the threads of the interior of the hollow female connector are configured to be urged tighter during contact of the club head with a golf ball.

6. The golf club of claim 1, wherein the second end of the first hollow shaft member comprises a first rounded edge and wherein and first end of the second hollow shaft member comprises a second rounded edge and wherein the hollow male connector and hollow female connector are sized to be contained completely within the interior of the first hollow shaft member and the second hollow shaft member when in the assembled configuration.

7. The golf club of claim 1, wherein the second end of first hollow shaft member and the first end of the second hollow shaft member have an interior diameter of $D_1$ and wherein $ID_a$ is at least 70% of $D_1$.

8. The golf club of claim 1, wherein the second end of first hollow shaft member and the first end of the second hollow shaft member have an interior diameter of $ID_1$ and wherein $ID_a$ is at least 75% of $D_1$.

9. The golf club of claim 1, wherein the second end of first hollow shaft member and the first end of the second hollow shaft member have an interior diameter of $D_1$ and wherein $ID_a$ is at least 85% of $D_1$, and wherein $ID_b$ is at least 40% of $D_1$.

10. A golf club having length, L, and a center of gravity comprising:

a first shaft member having a first end and a second end;

a second shaft member having a first end and a second end;

a club head coupled to the second end of the second shaft member;

a grip attached to the first end of the first shaft member;

a releasable, hollow connection unit comprising:

a hollow male connector having a first portion (which has an inside diamater of $ID_a$) and a second portion (which has an inside diameter of $ID_b$), the first portion coupled to either the second end of the first shaft member or the first end of the second shaft member, the second portion having external threads, a hollow female connector that has an inside diameter of $ID_c$ and having a threaded interior, the hollow female connector coupled to the second end of the first shaft member or the first end of the second shaft member, the threaded interior of the hollow female connector and the external threads of the second portion of the male connector sized and configured to releasably mate to form a connection and arranged to be urged tighter with each impact of the club head with a golf ball, and wherein $ID_a > ID_b$ and $ID_c > ID_b$; and wherein the center of gravity of the golf club with the connection varies less than about 5% of the club length, L, from the center of gravity of a club that is identical except having an un-severed shaft and having no hollow male connector and no hollow female connector and varies less than 5% in weight.

11. A method of manufacturing a golf club with a separable shaft for easy transportation, the method comprising the steps of:

providing a golf club having a hollow steel shaft;

cutting the shaft of the golf club at approximately a middle point of the shaft to form a first shaft member having a first end and a second end and a second shaft member having a first end and a second end;

coupling a hollow male connector, which has a first portion having an inside diameter of $ID_a$ and a second portion having external threads and having an inside diameter of $ID_b$ and where $ID_a > ID_b$, to the second end of the first shaft member or the first end of the second shaft member so that the external threads of the second portion of the male connector extend from the first shaft member or second shaft member;

coupling a hollow female connector, which an interior threaded portion that has an inside diameter of $ID_c$ and is sized and configured to mate with the external threads on the male connector and wherein $ID_c > ID_b$, to the second end of the first shaft member or the first end of the second shaft member; and wherein the interior threads of the hollow female connector and the external threads of the hollow male connector are configured to be urged tighter when the golf club hits a ball.

12. The method of manufacturing a golf club with a separable shaft as recited in claim 11, wherein the step of cutting a golf club into a first and second shaft members further comprises: rounding off the second end of the first shaft member and first end of the second shaft member, and abrading an interior portion of the first shaft member and an interior portion of the second shaft member.

13. The method of claim 11, wherein the step of cutting the shaft of the golf club comprises the steps of:

cutting the shaft at approximately a middle point, rounding of the second end of the first shaft member and the fist end of the second shaft member, and abrading an interior portion of the first shaft member and the second shaft member;

wherein the step of coupling a hollow male connector comprises the steps of:

abrading an exterior portion of the first portion of the male connector, applying an epoxy on the abraded exterior portion of the male connector or the abraded interior portion of either the first or second shaft member, inserting the first portion of the male connector into the second end of the first shaft member or the first end of the second shaft member, and allowing the epoxy to cure; and wherein the step of coupling the hollow female connector comprises the steps of: abrading an exterior portion of the hollow female connector, applying an epoxy on the exterior portion of the hollow female connector or the abraded interior portion of the first shaft member or second shaft member, inserting the female connector into the second end of the first shaft member or the first end of the second shaft member, and allowing the epoxy to cure.

14. A golf club having a length, L, and a center of gravity comprising:

a first hollow shaft member having a first end and a second end;

a second hollow shaft member having a first end and a second end;

a club head coupled to the second end of the second hollow shaft member;

a hollow male connector having a first portion and a second portion, the first portion coupled in an interior portion of the second end of the first hollow shaft member or to an interior portion of the first end of the second shaft member, and the second portion of the hollow male connector having external threads;

a hollow female connector having an exterior and a threaded interior, the exterior of the female connector coupled to the interior portion of the first end of the second shaft member or the interior portion of the second end of the first shaft member;

wherein the external threads of the second portion of the hollow male connector are sized and configured to mate with the threaded interior of the hollow female connector to provide a releasable connection allowing the club to have an assembled configuration and a disassembled configuration; and wherein the second end of first hollow shaft member and the first end of the second hollow shaft member have an interior diameter of $D_1$ and wherein the first portion of the hollow male connector has an interior diameter of $D_2$, and wherein $D_2$ is at least 85% of $D_1$, and wherein the second portion of the male connector has an interior diameter $D_3$ and wherein $D_3$ is at lest 40% of $D_1$.

* * * * *